US011773653B2

(12) United States Patent
Wang et al.

(10) Patent No.: US 11,773,653 B2
(45) Date of Patent: Oct. 3, 2023

(54) DOUBLE-LAYER COILED TUBING DOUBLE-GRADIENT DRILLING SYSTEM

(71) Applicant: SOUTHWEST PETROLEUM UNIVERSITY, Chengdu (CN)

(72) Inventors: Guorong Wang, Chengdu (CN); Lin Zhong, Chengdu (CN); Qingyou Liu, Chengdu (CN); Shouwei Zhou, Chengdu (CN); Xingyong Yu, Chengdu (CN); Zhong Li, Chengdu (CN); Yang Tang, Chengdu (CN); Qiang Fu, Chengdu (CN); Xin Huang, Chengdu (CN); Yanjun Li, Chengdu (CN); Hexing Liu, Chengdu (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 0 days.

(21) Appl. No.: 17/044,125

(22) PCT Filed: Dec. 23, 2019

(86) PCT No.: PCT/CN2019/127475
§ 371 (c)(1),
(2) Date: Sep. 30, 2020

(87) PCT Pub. No.: WO2021/127855
PCT Pub. Date: Jul. 1, 2021

(65) Prior Publication Data

US 2023/0085283 A1 Mar. 16, 2023

(51) Int. Cl.
*E21B 7/12* (2006.01)
*E21B 17/01* (2006.01)
(Continued)

(52) U.S. Cl.
CPC ..... *E21B 7/12* (2013.01); *E21B 17/01* (2013.01); *E21B 17/085* (2013.01); *E21B 33/076* (2013.01)

(58) Field of Classification Search
CPC .... E21B 43/121; E21B 21/082; E21B 21/001; E21B 21/08; E21B 33/076; E21B 17/085; E21B 17/01; E21B 7/12
See application file for complete search history.

(56) References Cited

U.S. PATENT DOCUMENTS 5,285,204 A * 2/1994 Sas-Jaworsky ..... G01V 11/002 340/856.1
5,503,014 A * 4/1996 Griffith ..... E21B 17/203 166/311
(Continued)

FOREIGN PATENT DOCUMENTS

CN 1932234 A 3/2007
CN 103696691 A 4/2014
(Continued)

*Primary Examiner* — Aaron L Lembo
(74) *Attorney, Agent, or Firm* — Jordan IP Law, LLC; Todd A. Vaughn

(57) ABSTRACT

A double-layer coiled tubing double-gradient drilling system, on the basis of conventional drilling equipment, includes a double-layer coiled tubing system, separating fluid, a downhole lifting pump system, throttling control systems and a data monitoring system. Power fluid enters an annular space of the tubing through an adapter, passes through a downhole lifting pump, enters an inner pipe through a bridge channel, and enters the bottom hole through the drill bit. Return fluid enters an annular channel of the tubing through a recovery hole, then enters the inner pipe through the bridge channel and enters the lifting pump, and then enters a solid control system through the adapter and the control systems in sequence. Gradient control of the bottom hole pressure is realized through monitoring of the
(Continued)

separating fluid and control of the drilling pump unit and throttling control systems. The problem of narrow safe drilling density window is solved.

10 Claims, 4 Drawing Sheets

(51) Int. Cl.
*E21B 17/08* (2006.01)
*E21B 33/076* (2006.01)

(56) References Cited

U.S. PATENT DOCUMENTS 6,457,540 B2 * 10/2002 Gardes ..... E21B 43/34 166/50
6,497,290 B1 * 12/2002 Misselbrook ..... E21B 34/066 166/77.2
6,712,150 B1 * 3/2004 Misselbrook ..... E21B 17/203 166/387
7,090,018 B2 * 8/2006 Livingstone ..... E21B 21/10 166/77.2
7,174,975 B2 * 2/2007 Krueger ..... E21B 43/122 175/57
7,185,718 B2 * 3/2007 Gardes ..... E21B 21/12 166/50
7,270,185 B2 * 9/2007 Fontana ..... E21B 33/076 166/347
7,708,057 B2 * 5/2010 Aivalis ..... E21B 17/028 166/85.1
9,249,646 B2 * 2/2016 Hannegan ..... E21B 47/001
10,273,763 B2 4/2019 Robichaux et al.
11,391,140 B2 * 7/2022 Nordsveen ..... E21B 17/20
2011/0247828 A1 10/2011 Patel et al.
2015/0027781 A1 * 1/2015 Vestavik ..... E21B 21/12 175/57
2021/0246733 A1 * 8/2021 Hebert ..... E21B 17/006

FOREIGN PATENT DOCUMENTS

CN 108049845 A 5/2018
CN 111021958 A 4/2020
EP 2412920 B1 3/2016

* cited by examiner

DOUBLE-LAYER COILED TUBING DOUBLE-GRADIENT DRILLING SYSTEM

CROSS REFERENCE TO RELATED APPLICATIONS

The present application is a National Stage Application of PCT International Application No. PCT/CN2019/127475 (filed on Dec. 23, 2019), under 35 U.S.C. § 371, the entire content of which is incorporated herein by reference in its complete entirety.

TECHNICAL FIELD

The invention relates to the field of deep-sea drilling, in particular, to a double-layer coiled tubing double-gradient drilling system.

BACKGROUND

At present, the global energy problem is getting worse, and the oil and gas resources on land and in shallow sea areas are far from meeting human needs. The exploration and development of deep-water oil and gas resources has become the current focus for development. However, when drilling in deep-sea areas, there are some problems such as narrow safety pressure window and weak cementing of seabed formation, which lead to difficult wellbore pressure control and poor borehole stability, thus resulting in high drilling safety risks and high cost.

Therefore, in order to promote the exploration and development of deep-water offshore oil and gas, how to propose an efficient and safe drilling technology is an urgent problem to be solved at present in view of the problems such as poor drilling safety, low formation leakage pressure and narrow safety density window of leak-prone producing layers and seabed loose surface layers during the development of deep-sea oil and gas and shallow-formation hydrates.

SUMMARY

The invention aims to provide a double-layer coiled tubing double-gradient drilling system which can effectively widen the safety density window and improve the well control capability of dangerous formations.

In order to achieve the above purpose, the invention provides the following scheme:

The invention provides a double-layer coiled tubing double-gradient drilling system, which comprises a double-layer coiled tubing system, a drilling fluid circulating system and a downhole lifting pump system, wherein the double-layer coiled tubing system and the drilling fluid circulating system are installed on a drilling ship; the double-layer coiled tubing system comprises a double-layer coiled tubing, a drum, a double-layer tubing injector and an adapter; the double-layer coiled tubing comprises an outer tube and an inner tube fixed inside the outer tube through an adjusting sleeve; an annular channel is formed between the outer tube and the inner tube; the top of the double-layer coiled tubing is wound around the drum and connected with the drilling fluid circulating system through the adapter; the drum is used for distributing, recovering or storing the double-layer coiled tubing, and the adapter is installed on the drum; the bottom of the double-layer coiled tubing extends underwater through the double-layer tubing injector, and the tail end of the double-layer coiled tubing is provided with the downhole lifting pump system, a downhole motor and a drill bit;

the suction and outlet ends of the downhole lifting pump system are provided with a first test nipple and a second test nipple respectively; the downhole lifting pump system comprises a lifting pump, a bridge channel and a driving part which are sequentially arranged; the two ends of the bridge channel are connected with a drilling fluid outlet and a return fluid inlet respectively;

drilling fluid is discharged into a well from the drilling fluid circulating system through the adapter, the annular channel, the first test nipple, the bridge channel, the second test nipple and the inner tube in sequence, and return fluid returns to the drilling fluid circulating system from the well through the annular channel, the second test nipple, the bridge channel, the first test nipple, the inner tube and the adapter in sequence to realize drilling fluid circulation;

the drilling fluid circulating system is internally provided with a data monitoring system and throttling control systems in signal connection with the data monitoring system, wherein the throttling control systems are used for real-time flow control of the drilling fluid and/or return fluid, and the data monitoring system is used for monitoring the circulation state of the drilling fluid and/or return fluid in real time.

Alternatively, the double-layer coiled tubing system further comprises a truncated pyramid-shape drilling rig, wherein the truncated pyramid-shape drilling rig is fixed on the drilling ship, a crown block is arranged on the top of the truncated pyramid-shape drilling rig, a traveling block is connected to the bottom of the crown block through a steel wire rope, and a hook is arranged below the traveling block for hanging the double-layer tubing injector.

Alternatively, the double-layer tubing injector comprises a frame, a driving roller, a driven roller and a power device, wherein the driving roller and the driven roller are arranged on the frame in parallel, the driving roller and the driven roller can clamp the double-layer coiled tubing, and the power device is connected with the driving roller and drives the driving roller to rotate forward and backward.

Alternatively, the drilling fluid circulating system comprises a drilling pump unit, a solid control system and a mud pit, wherein the mud pit is connected with the adapter through an injection pipeline, the adapter is connected with the mud pit through a return pipeline, the drilling pump unit is arranged on the injection pipeline, and the solid control system is arranged on the return pipeline; and the solid control system comprises a vibrating screen, a desander, a desilter, and a degasser which are sequentially arranged along the liquid flow direction.

Alternatively, the double-layer coiled tubing is sleeved with a riser, the riser is installed above a rotary table through a riser chuck, the riser chuck is connected with the rotary table through a universal joint, and the rotary table is installed on the drilling ship.

Alternatively, a diverter is installed at the top of the riser, and a bypass pipeline is led out from the bottom of the solid control system to be connected with the diverter; the bypass pipeline and the return pipeline are both provided with the throttling control systems, the return pipeline and the injection pipeline are both provided with flow meters and pressure meters, and each pressure meter and each flow meter are in signal connection with the data monitoring system; the bottom of the riser is connected with a blowout preventer unit, the blowout preventer unit is positioned at a wellhead, a casing is installed in the well, and the top of the casing is connected with the blowout preventer unit; and an annular space between the casing and the outer coil is filled with separating fluid, and the separating fluid is positioned at a mud line and is used for separating upper seawater from the drilling fluid below.

Alternatively, the adapter comprises a housing and a double-layer conversion sleeve installed in the housing, wherein one end of the double-layer conversion sleeve is connected with the inner coil and the outer coil of the double-layer coiled tubing through a pipe connector, and the other end is connected with the return pipeline and the injection pipeline through a pipe connector.

Alternatively, a recovery nipple is further arranged between the second test nipple and the downhole motor, and the double-layer coiled tubing, the first test nipple, the downhole lifting pump system, the second test nipple, the recovery nipple and the downhole motor are sequentially connected through double-layer coiled tubing adapters.

Alternatively, the driving part is a hydraulic motor or an electric motor, and when the lifting pump supplies power through the electric motor, the power of the electric motor is supplied through a cable or the double-layer coiled tubing with an insulating layer.

Compared with the prior art, the invention has the following technical effects:

The double-layer coiled tubing double-gradient drilling system provided by the invention can widen the safe drilling density window, effectively control the bottom hole pressure, greatly reduce potential safety hazards such as blowout and lost circulation, save the risk control cost of deep-sea drilling, and solve the technical problems such as well control, lost circulation, and risk control of natural gas hydrates in the deep-water drilling process, and has strong practicability.

BRIEF DESCRIPTION OF THE DRAWINGS

In order to more clearly explain the embodiments of the present invention or the technical scheme in the prior art, the following will briefly introduce the drawings needed in the embodiments. Obviously, the drawings in the following description are only some embodiments of the present invention. For those skilled in the art, other drawings can be obtained according to these drawings without creative labor.

DESCRIPTION OF THE EMBODIMENTS

Hereinafter, the technical scheme in the embodiments of the present invention will be described clearly and completely with reference to the drawings in the embodiments of the present invention. Obviously, the described embodiments are only part of the embodiments of the present invention, not all of the embodiments. Based on the embodiments of the present invention, all other embodiments obtained by those of ordinary skill in the art without creative labor are within the scope of the present invention.

In order to make the above objects, features and advantages of the present invention better understood, the present invention will be described in further detail below with reference to the accompanying drawings and detailed description.

Embodiment 1

Figure 1:
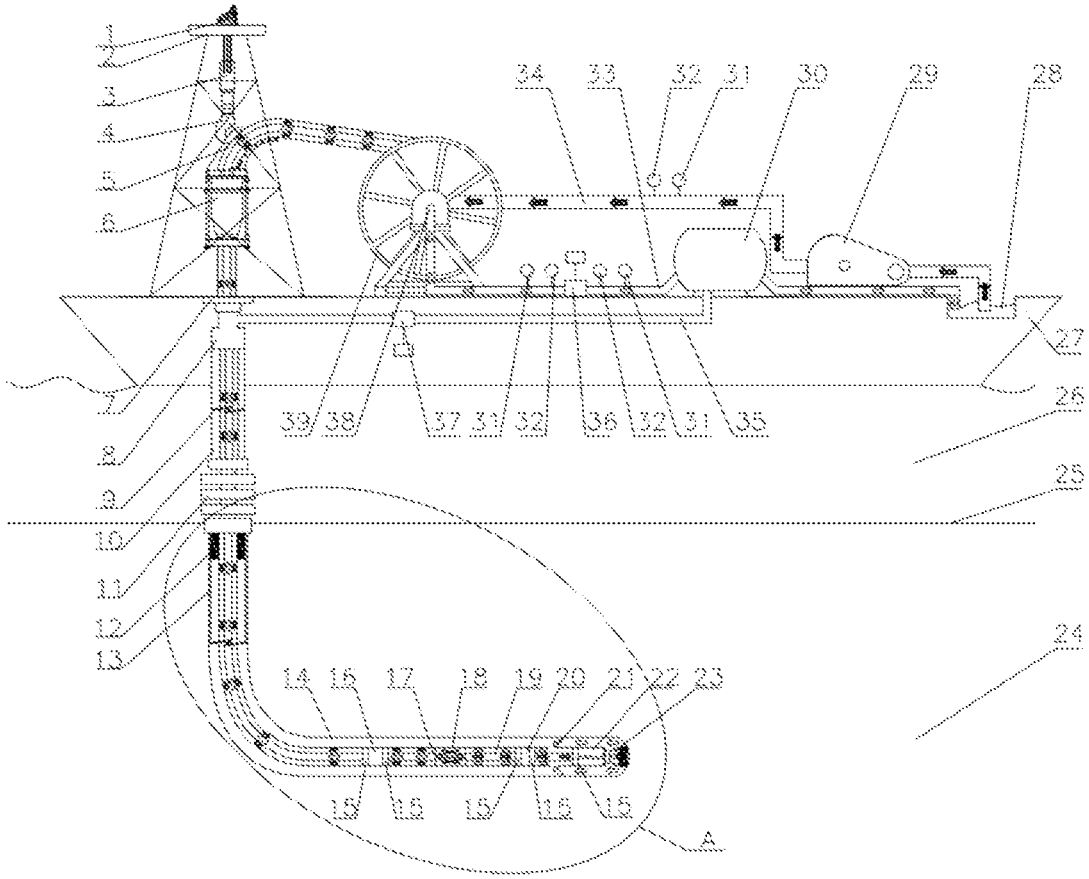
FIG. 1 is a diagram of the overall structure of a double-layer coiled tubing double-gradient drilling system of the present invention.
Figure 2:
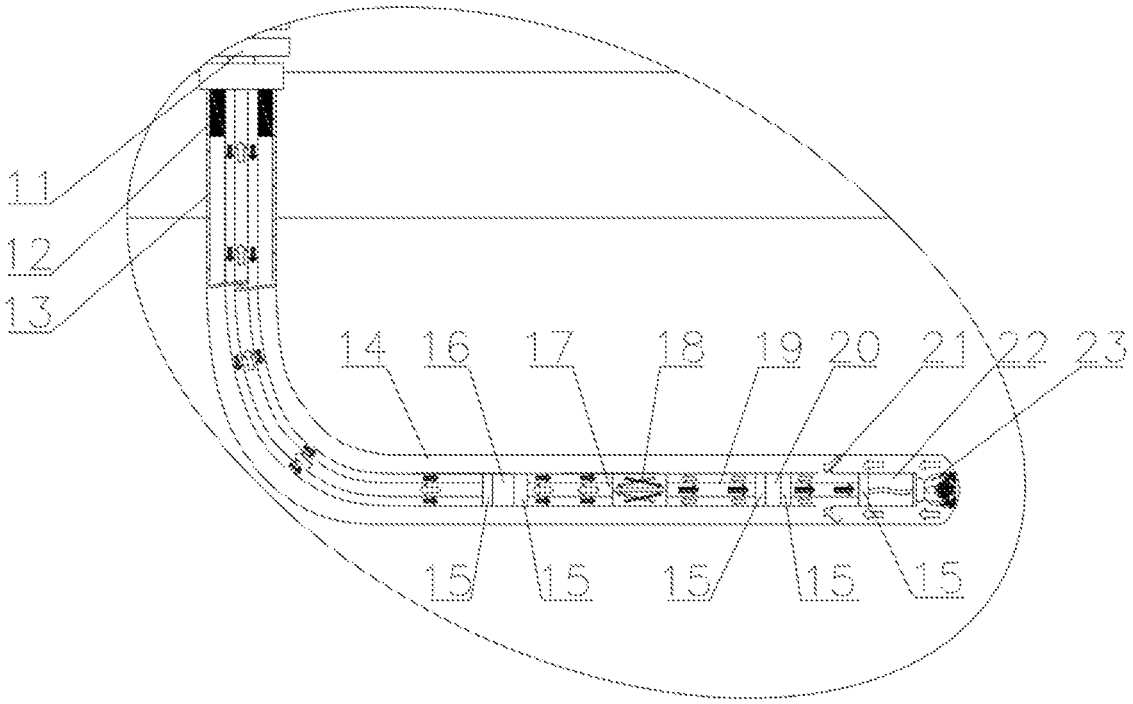
FIG. 2 is a partially enlarged view of A in FIG. 1.
Figure 3:
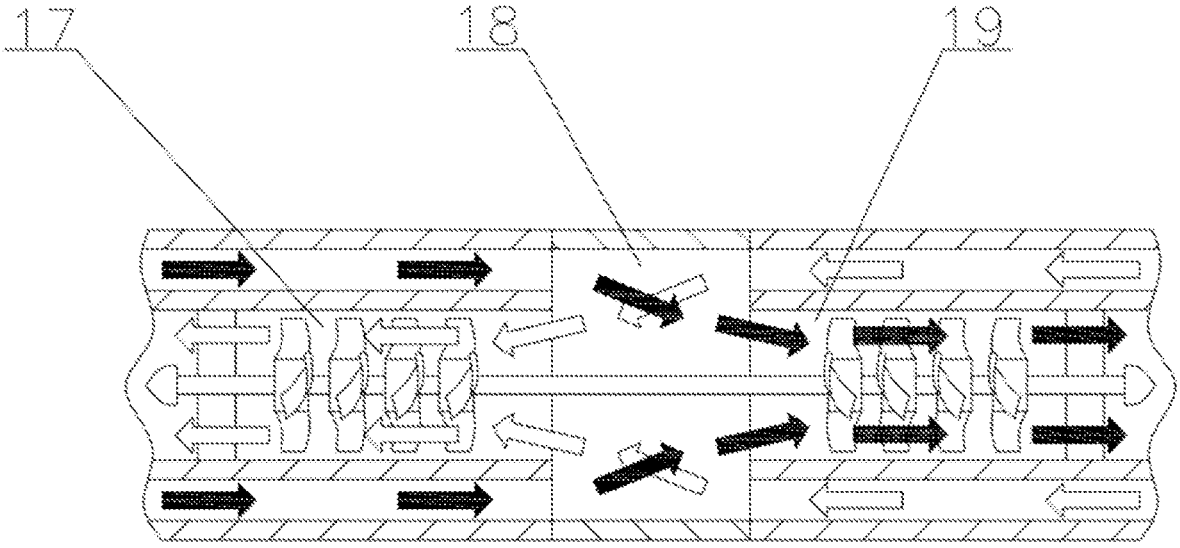
FIG. 3 is a structural diagram of a downhole lifting pump system of the present invention.

As shown in FIGS. 1-3, the embodiment provides a double-layer coiled tubing double-gradient drilling system, which comprises a double-layer coiled tubing system, a drilling fluid circulating system and a downhole lifting pump system, wherein the double-layer coiled tubing system and the drilling fluid circulating system are installed on a drilling ship 27; the double-layer coiled tubing system comprises a double-layer coiled tubing 5, a drum 39, a double-layer tubing injector 6 and an adapter 38; the double-layer coiled tubing 5 comprises an outer coil and an inner coil fixed inside the outer coil through an adjusting sleeve; an annular channel is formed between the outer coil and the inner coil; the top of the double-layer coiled tubing 5 is wound around a rotating shaft of the drum 39 and is connected with the drilling fluid circulating system through the adapter 38; the drum 39 is used for distributing, recovering or storing the double-layer coiled tubing 5, and the adapter 38 is installed on the drum 39; the bottom of the double-layer coiled tubing 5 extends into seawater 26 below a mud line 25 through the double-layer tubing injector 6, and the tail end of the double-layer coiled tubing 5 is provided with the downhole lifting pump system, a downhole motor 22 and a drill bit 23 connected with the downhole motor 22; the two ends of the downhole lifting pump system are provided with a first test nipple 16 and a second test nipple 20 respectively; the downhole lifting pump system comprises a lifting pump 17, a bridge channel 18 and a driving part which are sequentially arranged; and the two ends of the bridge channel 18 are connected with a drilling fluid outlet and a return fluid inlet respectively. In this embodiment, the driving part is preferably a hydraulic motor 19.

Drilling fluid (power fluid) 14 is discharged into a well from the drilling fluid circulating system through the adapter 38, the annular channel, the first test nipple 16, the bridge channel 18, the second test nipple 20 and the inner coil in sequence, and return fluid returns to the drilling fluid circulating system through the annular channel, the second test nipple 20, the bridge channel 18, the first test nipple 16, the inner coil and the adapter 38 in sequence from the well, thus realizing drilling fluid circulation; and the first test nipple 16 and the second test nipple 20 are installed at an inlet end and an outlet end of the lifting pump 17 respectively for monitoring the inlet and outlet pressure, flow rate and temperature parameters of the lifting pump 17.

The drilling fluid circulating system is internally provided with a data monitoring system and throttling control systems in signal connection with the data monitoring system, wherein the throttling control systems are used for real-time flow control of the drilling fluid and/or return fluid, and the data monitoring system is used for monitoring the circulation state of the drilling fluid and/or return fluid in real time.

In this specific embodiment, as shown in FIG. 1, the double-layer coiled tubing system further comprises a truncated pyramid-shape drilling rig 2, the truncated pyramid-shape drilling rig 2 is fixed on the drilling ship 27, a crown block 1 is installed on the top of the truncated pyramid-shape drilling rig 2, a traveling block 3 is connected to the bottom of the crown block 1 through a steel wire rope, and a hook 4 is arranged below the traveling block 3 for hanging the double-layer tubing injector 6. The traveling block 3 is preferably a movable pulley block which is connected with the crown block 1 through a steel wire rope and moves up and down inside the derrick. The crown block 1 and the traveling block 3 are both of existing structures and are used for adjusting the rise and fall of the hook 4 in this embodiment.

Further, in this embodiment, the double-layer tubing injector 6 comprises a frame, a driving wheel, a driven wheel and a power device, wherein the driving roller and the driven roller are arranged on the frame in parallel, the double-layer coiled tubing 5 is clamped between the driving roller and the driven roller, and the power device is connected with the driving roller and drives the driving roller to rotate forward and backward; and through the forward and backward rotation of the driving roller, the double-layer coiled tubing 5 can be lifted or lowered to ensure continuous operation in deep water. The specific structural composition and working principle of the above-mentioned double-layer tubing injector 6 are all prior art and will not be repeated here.

Further, in this embodiment, the drilling fluid circulating system comprises a drilling pump unit 29, a solid control system 30 and a mud pit 28, wherein the mud pit 28 is connected with the adapter 38 through an injection pipeline 34, the adapter 38 is connected with the mud pit 28 through a return pipeline 33, the drilling pump unit 29 is arranged on the injection pipeline 34, and the solid control system 30 is arranged on the return pipeline 33; the solid control system 30 comprises a vibrating screen, a desander, a desilter and a degasser which are sequentially arranged along the flow direction of the return fluid and are used for removing cuttings, sand grains, gases and the like contained in the return fluid; besides, the mud pit 28 can accumulate the return fluid which passes through the solid control system 30 and supply the power fluid (drilling fluid 14) to the drilling pump unit 29 to realize circulation. The structural composition, working principle and applicable working conditions of the solid control system 30 are well known in the art and will not be described here. Three to four groups of pumps can be preferably arranged in the drilling pump unit 29 to work in parallel, and one or more of the pumps can be started to work simultaneously according to the required pump fluid pressure.

Further, in this embodiment, the double-layer coiled tubing 5 is sleeved with a riser 9, the riser 9 is installed above a rotary table through a riser chuck, the riser chuck is connected with the rotary table through a universal joint, and the rotary table is installed on the drilling ship 27. As shown in FIG. 1, the riser chuck and the universal joint 7 are installed above the rotary table, the riser chuck is used to clamp the riser 9 and support the weight of the riser 9 and the blowout preventer unit when a riser column is lifted and a single riser is connected, so as to facilitate quick connection and detachment of a joint of the riser 9, and the universal joint can compensate for the riser offset caused by the flow of seawater 10.

Further, in this embodiment, as shown in FIG. 1, a diverter 8 is installed at the top of the riser 9, and a bypass pipeline 35 is led out from the bottom of the solid control system 30 to be connected with the diverter 8; the bypass pipeline 35 and the return pipeline 33 are provided with a second throttling control system 37 and a first throttling control system 36 respectively, the return pipeline 33 and the injection pipeline 34 are both provided with flow meters 32 and pressure meters 31, and each pressure meter 31 and each flow meter 32 are in signal connection with the data monitoring system; the bottom of the riser 9 is connected with a blowout preventer unit, which is located at a wellhead, such as the blowout preventer unit and wellhead device 11 shown in FIG. 1; and a casing 13 is installed in the well for supporting a sidewall and keeping the sidewall stable, and the top of the casing 13 is connected with the blowout preventer unit. The blowout preventer unit and wellhead device 11 comprises a deep-water blowout preventer unit and a wellhead device. The blowout preventer unit consists of two sets of annular blowout preventers and four sets of ram blowout preventers, which can seal an annular space of a running string and effectively shut in the well after cutting a well cable and the double-layer coiled tubing 5. The wellhead device comprises guide base, guide structure, well head system and a special connector, and is used for fixing a seabed well site, hanging a casing head, guiding drilling tools and other underwater equipment, measuring the wellhead pressure and the like. The structure and working principle of the above blowout preventer unit are well known in the art and will not be repeated here.

As shown in FIG. 1, the annular space between the casing 13 and the outer coil of the double-layer coiled tubing 5 is filled with separating fluid 12, and the separating fluid 12 is located at the mud line 25 and is used to separate upper seawater from the drilling fluid below. The separating fluid 12 is preferably a partition type special gel. Before drilling, after the drill bit 23 is lowered to a certain distance below the mud line 25, the lowering of the drill bit 23 is stopped and an inner coil channel of the double-layer coiled tubing 5 is closed, the bypass pipeline 35 is opened, and a section of separating fluid 12 is injected into the annular space between the double-layer coiled tubing 5 and the casing 13. Under the driving of the power fluid, the drill bit 23 is continuously lowered to prepare for drilling after the separating fluid 12 reaches the vicinity of the mud line 25 in the annular space between the double-layer coiled tubing 5 and the casing 13.

Further, in this embodiment, as shown in FIG. 1, the adapter 38 comprises a housing, a double-layer conversion sleeve installed in the housing and a rotary sealing mechanism; the double-layer conversion sleeve comprises two layers of mutually independent channels which are coaxial, namely an inner coil channel and an inner and outer coil annular channel, one end of the inner coil channel is connected with the inner coil of the double-layer coiled tubing 5 through an inner coil connector, and one end of the inner and outer coil annular channel is connected with the annular channel of the double-layer coiled tubing 5 through an outer coil connector; correspondingly, the other ends of the inner coil channel and the inner and outer coil annular channel are connected with the return pipeline 33 and the injection pipeline 34 through pipe connectors respectively; the drilling fluid 14 enters the annular channel of the double-layer coiled tubing 5 from the inner and outer coil annular channel of the adapter 38 through the injection pipeline 34, and the return fluid enters the return pipeline 33 from the inner coil channel of the adapter 38 through the inner coil of the double-layer coiled tubing 5, thus realizing continuous inflow of the power fluid from the annular channel of the double-layer coiled tubing 5 and continuous outflow of the return fluid from the inner coil of the double-layer coiled tubing 5. The adapter 38 is an existing structure, and its specific working principle will not be described here.

Further, in this embodiment, as shown in FIG. 1, a recovery nipple 21 is further arranged between the second test nipple 20 and the downhole motor 22, and the double-layer coiled tubing 5, the first test nipple 16, the downhole lifting pump system, the second test nipple 20, the recovery nipple 21 and the downhole motor 22 are sequentially connected through double-layer coiled tubing adapters 15, wherein the structural composition and working principle of the double-layer coiled tubing adapters 15 are shown in the invention patent application No. CN201811244524.X. A drilling fluid channel sequentially communicates with the drilling pump unit 29, the injection pipeline 34, the adapter 38, the annular channel of the double-layer coiled tubing 5, an outer channel of the first test nipple 16, an outer channel of the lifting pump 17, the bridge channel 18, an inner channel of the second test nipple 20, an inner channel of the recovery nipple 21, the downhole motor 22 and the drill bit 23 from top to bottom; and a return fluid channel sequentially communicates with an outer channel of the recovery nipple 21, an outer channel of the second test nipple 20, the bridge channel 18, an inner channel of the lifting pump 17, an inner channel of the first test nipple 16, the inner coil of the double-layer coiled tubing 5, the adapter 38, the return pipeline 33 and the solid control system 30 from bottom to top.

In this embodiment, the first throttling control system 36 and the second throttling control system 38 have the same structure, are composed of an electrically controlled throttle valve, a control system, etc., and can control the opening and closing of the inner coil channel (return pipeline 33) and the bypass pipeline 35 of the double-layer coiled tubing 5. The data monitoring system is used for monitoring the injection pressure and flow rate of the drilling pump unit 29, the pressure and flow rate of the return fluid, the liquid level and pressure of the separating fluid 12, and the inlet and outlet pressure and flow rate of the lifting pump 17, and controlling the flow rate of the return fluid and the displacement of the drilling pump 29.

The following is a description of a specific drilling method based on the double-layer coiled tubing double-gradient drilling system provided in this embodiment.

First, the drilling fluid 14 (the direction indicated by the black arrow in FIG. 3 is the flow direction of the drilling fluid) is injected from the drilling pump unit 29, enters the annular channel of the double-layer coiled tubing 5 through the adapter 38, passes through the outer channel of the first test nipple 26 to the lifting pump 17, then enters the inner channel of the second test nipple 20 under the direction changing effect of the bridge channel 18, and enters the bottom hole to crush rocks and carry cuttings through the inner channel of the recovery nipple 21, the downhole motor 22 and the drill bit 23; and the return fluid (the direction indicated by the white arrow in FIG. 3 is the flow direction of the return fluid) enters the outer channel of the recovery nipple 21 and the outer channel of the second test nipple 20 in sequence, then enters the inner channel of the lifting pump 17 through the bridge channel 18 to obtain energy, and then enters the solid control system 30 through the inner channel of the first test nipple 16, the inner coil of the double-layer coiled tubing 5, the adapter 38 and the first throttling control system 36 in sequence to return to the mud pit 28; and the circulation is monitored in real time by the data monitoring system.

Before the drilling pump unit 29 starts drilling, the inner coil channel of the double-layer coiled tubing 5 is opened and the bypass pipeline 35 is closed to realize small-displacement circulation. After the circulation of the drilling fluid 14 becomes smooth, the pump displacement is adjusted to start drilling.

The data monitoring system determines the bottom hole condition by monitoring the changes of the pressure and liquid level of the separating fluid 12, the opening degree of a throttle valve is adjusted in real time through the first throttling control system 36, the displacement of the drilling pump unit 29 is adjusted through the data monitoring system, the lift of the lifting pump 17 is adjusted by controlling the difference between the inlet amount and outlet amount of the drilling fluid 14, the pressure of an inner coil liquid column of the double-layer coiled tubing 5 acting on the bottom hole is changed, so that the separating fluid 12 is in a state of dynamic equilibrium at the balance position, thus realizing the regulation and maintenance of the pressure gradient.

In this embodiment, the upper seawater 10 and the drilling fluid 14 below are separated by the separating fluid 12 to form three different liquid columns, and the double-layer coiled tubing 5 forms a channel for injecting and returning the drilling fluid 14, which is realized by the circulation formed by the lifting pump 17. Under the condition of using the riser 9, the three liquid columns are realized by separating the seawater 10 between the double-layer coiled tubing 5 and the riser 9 and the drilling fluid 14 between the double-layer coiled tubing 5 and the casing 13 through the separating fluid 12.

In the absence of the riser 9, the three liquid columns are realized by installing a sliding packer at the upper part of the blowout preventer unit. The sliding packer can realize slide-sealing during the movement of double-layer coiled tubing 5. A density control valve is arranged on the sliding packer to prevent the outflow of the separating fluid 12 and the free inflow and outflow of the seawater 26, thus forming the three liquid columns, namely the seawater 26, the separating fluid 12 and the drilling fluid 14. This separation technique is a well-known technique in the art and will not be repeated here.

Downhole monitoring or power supply of other equipment can use an outer wall of the inner coil and an inner wall of the outer coil of the double-layer coiled tubing 5 as coaxial cables after insulation treatment, or power can be supplied by penetrating a cable 40 into the annular channel of the double-layer coiled tubing 5.

When the data monitoring system monitors that the flow rate of the return fluid is very small or there is no return fluid, the inner coil channel of the double-layer coiled tubing 5 is closed through the first throttling control system 36, and then the bypass pipeline 35 is opened through the second throttling control system 37; and the return fluid returns through the annular space between the double-layer coiled tubing 5 and the sidewall and the annular space between the double-layer coiled tubing 5 and the riser 9, enters the bypass pipeline 35 through the diverter 8 at the upper end of the riser 9 and then enters the solid control system 30.

It can be seen that on the basis of conventional drilling equipment, this embodiment is provided with the double-layer coiled tubing system, the separating fluid, the downhole lifting pump system, the throttling control systems and the data monitoring system; the power fluid is injected through the drilling pump unit, enters the annular space of the double-layer tubing through the adapter, passes through the downhole lifting pump, enters the inner coil of the double-layer coiled tubing through the bridge channel, and enters the bottom hole through the downhole motor and the drill bit; the return fluid enters the annular channel of the double-layer coiled tubing through a recovery hole, then enters the inner coil of the double-layer coiled tubing through the bridge channel and enters the downhole lifting pump, and then enters the solid control system through the adapter and the throttling control systems in sequence; according to the invention, drill rods do not need to be connected, drilling time is saved, gradient control of the bottom hole pressure is realized through monitoring of the separating fluid and control of the drilling pump unit, the problem of narrow safe drilling density window is solved, the drilling cost and risks are reduced, the efficiency is improved, and the practicability is strong.

Embodiment 2

Figure 4:
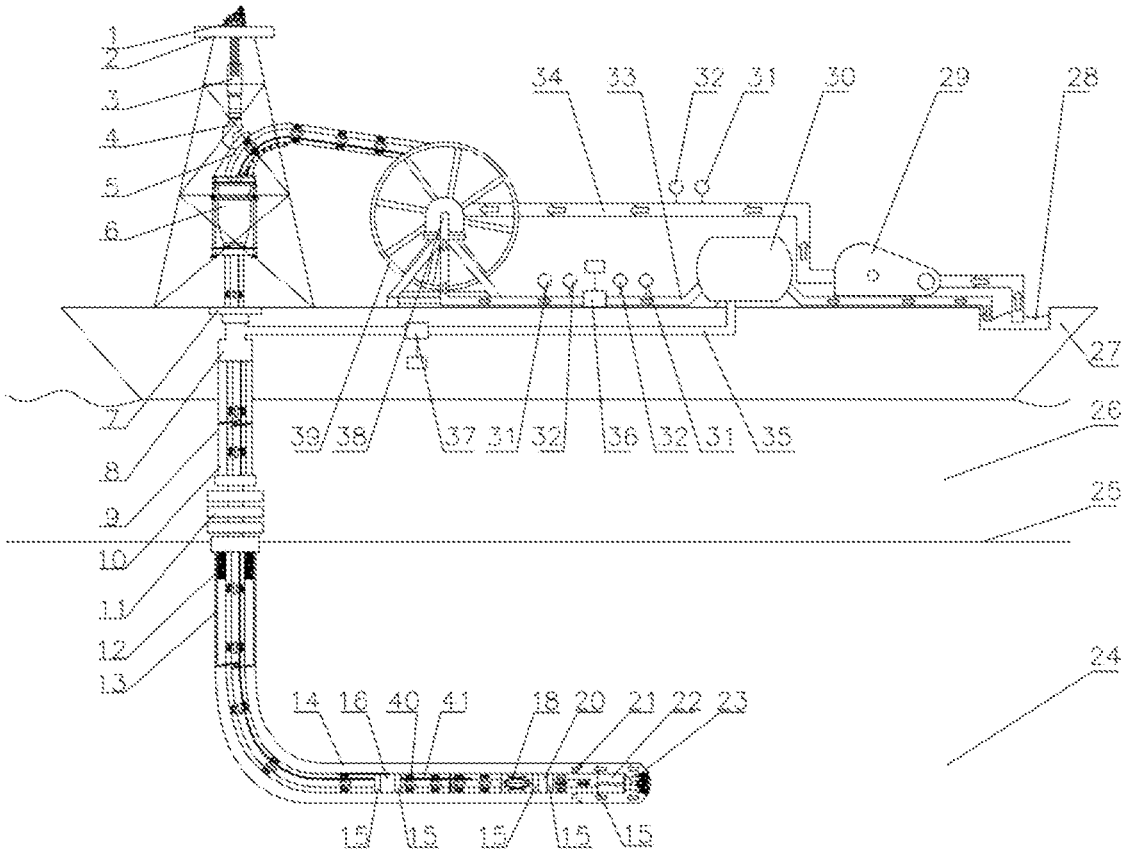
FIG. 4 is a diagram of the overall structure of a double-layer coiled tubing double-gradient drilling system using an electric motor instead of a hydraulic motor according to the present invention.

As shown in FIG. 4, this embodiment provides a double-layer coiled tubing double-gradient drilling system, wherein the driving part is preferably an electric motor 41. When the lifting pump 17 uses the electric motor 41 instead of the hydraulic motor 19 to provide power, its power is supplied through the cable 40 or the double-layer coiled tubing 5 with an insulating layer, which can reduce the energy consumption of the drilling fluid 14 before reaching the bottom hole and reduce the burden on the drilling pump unit 29.

Other structures of this embodiment are the same as those of Embodiment 1, and will not be described here.

It should be noted that it is obvious to those skilled in the art that the present invention is not limited to the details of the above-mentioned exemplary embodiments, but can be implemented in other specific forms without departing from the spirit or basic features of the present invention. Therefore, the embodiments should be regarded as exemplary and non-limiting in every respect. The scope of the present invention is defined by the appended claims rather than the above description. Therefore, it is intended to include all changes that fall within the meaning and range of equivalent elements of the claims, and any reference signs in the claims should not be regarded as limiting the claims involved.

In the present invention, specific examples are applied to explain the principle and implementation of the present invention. The above embodiments are only used to help understand the method of the present invention and its core ideas. For those skilled in the art, according to the idea of the present invention, there will be changes in the specific implementation and application scope. In summary, the contents of this specification should not be construed as limiting the present invention.

LIST OF REFERENCE SYMBOLS

1 crown block
2 truncated pyramid-shape drilling rig
3 traveling block
4 hook
5 double-layer coiled tubing
6 double-layer tubing injector
7 riser chuck and universal joint
8 diverter
9 riser
10 seawater
11 blowout preventer unit and wellhead device
12 separating fluid
13 casing
14 drilling fluid
15 double-layer coiled tubing adapter
16 first test nipple
17 lifting pump
18 bridge channel
19 hydraulic motor
20 second test nipple
21 recovery nipple
22 downhole motor
23 drill bit
24 reservoir
25 mud line
26 seawater
27 drilling ship
28 mud pit
29 drilling pump unit
30 solid control system
31 pressure meter
32 flow meter
33 return pipeline
34 injection pipeline
35 bypass pipeline
36 first throttling control system
37 second throttling control system
38 adapter
39 drum
40 cable
41 electric motor

What is claimed is:

1. A double-layer coiled tubing double-gradient drilling system, comprising:

a drilling fluid circulating system, configured for installation on a drilling ship, the drilling fluid circulating system being internally provided with a data monitoring system and throttling control systems in signal connection with the data monitoring system, the throttling control systems configured for real-time flow control of a drilling fluid and/or a return fluid, the data monitoring system configured for monitoring in real time a circulation state of the drilling fluid and/or the return fluid;

a downhole lifting pump system, that comprises a lifting pump, a bridge channel and a driving part which are sequentially arranged, two ends of the bridge channel being connected with a drilling fluid outlet and a return fluid inlet respectively, a drum, a double-layer tubing injector, and an adapter configured for installation on the drum, wherein two ends of the downhole lifting pump system are provided with a first test nipple and a second test nipple, respectively; and a double-layer coiled tubing system, configured for installation on a drilling ship to be distributed, recovered, or stored by the drum, the double-layer coiled tubing system including a double-layer coiled tubing that includes an outer coil and an inner coil fixed inside the outer coil through an adjusting sleeve, an annular channel formed between the outer coil and the inner coil, a top of the double-layer coiled tubing being wound around the drum and connected with the drilling fluid circulating system through the adapter, a bottom of the double-layer coiled tubing extending underwater through the double-layer tubing injector, and a tail end of the double-layer coiled tubing being provided with the downhole lifting pump system, a downhole motor, and a drill bit, wherein:

the drilling fluid is to be discharged into a well from the drilling fluid circulating system through, in sequence, the adapter, the annular channel, the first test nipple, the bridge channel, the second test nipple, and the inner coil, and the return fluid is to return to the drilling fluid circulating system, in sequence, from the well through the annular channel, the second test nipple, the bridge channel, the first test nipple, the inner coil, and the adapter to realize drilling fluid circulation wherein the drilling fluid circulating system comprises:

a mud pit connected with the adapter through an injection pipeline, the adapter being connected with the mud pit through a return pipeline;

a drilling pump unit arranged on the injection pipeline; and a solid control system arranged on the return pipeline, the solid control system comprising a vibrating screen, a desander, a desilter, and a degasser which are sequentially arranged along a liquid flow direction;

wherein the adapter comprises:

a housing; and a double-laver conversion sleeve installed in the housing, one end of the double-laver conversion sleeve being connected with the inner coil and the outer coil of the double-laver coiled tubing through a first pipe connector, and another end of the double-laver conversion sleeve being connected with the return pipeline and the injection pipeline through a second pipe connector.

2. The double-layer coiled tubing double-gradient drilling system of claim 1, wherein the double-layer coiled tubing system further comprises:

a truncated pyramid-shape drilling rig configured to be fixed on the drilling ship;

a crown block arranged on a top of the truncated pyramid-shape drilling rig;

a traveling block connected to a bottom of the crown block through a steel wire rope; and a hook arranged below the traveling block for hanging the double-layer tubing injector.

3. The double-layer coiled tubing double-gradient drilling system of claim 1, wherein the double-layer tubing injector comprises:

a frame;

a driving roller, configured to clamp the double-layer coiled tubing;

a driven roller, configured to clamp the double-layer coiled tubing, and arranged on the frame in parallel with the driving roller; and a power device connected with the driving roller and configured to drive the driving roller to rotate forward and backward.

4. The double-layer coiled tubing double-gradient drilling system of claim 1, wherein the double-layer coiled tubing is sleeved with a riser configured for installation above a rotary table through a riser chuck which is connected with the rotary table through a universal joint, the rotary table being configured for installation on the drilling ship.

5. The double-layer coiled tubing double-gradient drilling system of claim 4, further comprising:

a diverter configured for installation at a top of the riser; and a bypass pipeline configured to be led out from a bottom of the solid control system for connection with the diverter.

6. The double-layer coiled tubing double-gradient drilling system of claim 5, wherein:

the bypass pipeline and the return pipeline are both provided with the throttling control systems, the return pipeline and the injection pipeline are both provided with flow meters and pressure meters, each pressure meter and each flow meter being in signal connection with the data monitoring system, a bottom of the riser is connected with a blowout preventer unit configured for positioning at a wellhead, a casing is installed in the well, the top of the casing being connected with the blowout preventer unit, and an annular space between the casing and the outer coil is filled with separating fluid positioned at a mud line to separate upper seawater from the drilling fluid below.

7. The double-layer coiled tubing double-gradient drilling system of claim 1, further comprising a recovery nipple arranged between the second test nipple and the downhole motor, wherein the double-layer coiled tubing, the first test nipple, the downhole lifting pump system, the second test nipple, the recovery nipple, and the downhole motor are sequentially connected through double-layer coiled tubing adapters.

8. The double-layer coiled tubing double-gradient drilling system of claim 1, wherein the driving part comprises a hydraulic motor or an electric motor.

9. The double-layer coiled tubing double-gradient drilling system of claim 1, wherein the lifting pump is configured to supply power through the electric motor such that power of the electric motor is supplied through a cable or the double-layer coiled tubing with an insulating layer.

10. A drilling method based on the double-layer coiled tubing double-gradient drilling system according to claim 5, the method comprising:

injecting the drilling fluid from the drilling pump unit so as to enter the annular channel through the adapter, pass through the outer channel of the first test nipple to the downhole lifting pump, then enter the inner channel of the second test nipple through the bridge channel, and enter the bottom hole to crush rocks and carry cuttings through the inner channel of the recovery nipple, the downhole motor and the drill bit, and the return fluid enters the outer channel of the recovery nipple and the outer channel of the second test nipple in sequence through a recovery hole, then enters the inner channel of the lifting pump through the bridge channel to obtain energy, and then enters the solid control system through the inner channel of the first test nipple, the inner coil of the double-layer coiled tubing, the adapter, and the throttling control system in sequence; and monitoring, in real time via the data monitoring system, circulation of the drilling fluid;

opening the inner coil channel of the double-layer coiled tubing and closing the bypass pipeline, before the drilling pump unit commences drilling, to realize small-displacement circulation;

adjusting, after the circulation of the drilling fluid becomes smooth, the pump displacement to commence drilling;

determining, via the data monitoring system, the bottom hole condition by monitoring changes of pressure and liquid level of separating fluid;

adjusting, in real time via the throttling control system, an opening degree of a throttle valve;

adjusting, in real time via the data monitoring system, a displacement of the drilling pump unit;

adjusting a lift of the lifting pump by controlling a difference between an inlet amount and an outlet amount of the drilling fluid;

changing a pressure of an inner coil liquid column of the double-layer coiled tubing acting on the bottom hole such that the separating fluid is in a state of dynamic equilibrium at the balance position, to realize regulation and maintenance of a pressure gradient;

determining, when the data monitoring system monitors that the flow rate of the return fluid is very small or there is no return fluid, and the level of the separating fluid in the annular space is increased, whether the downhole lifting pump generates a blockage fault, while also closing, via a first throttling control system in the throttling control systems, the inner coil channel of the double-layer coiled tubing, and then opening the bypass pipeline is opened through a second throttling control system in the throttling control systems, and returning the return fluid through the annular space between the double-layer coiled tubing and the sidewall and the annular space between the double-layer coiled tubing and the riser, the return fluid sequentially entering the bypass pipeline and the solid control system through the diverter at the upper end of the riser.

* * * * *